US005354453A

United States Patent [19]

Bhatia

[11] Patent Number: 5,354,453

[45] Date of Patent: Oct. 11, 1994

[54] REMOVAL OF $H_2S$ HYDROCARBON LIQUID

[75] Inventor: Kishan Bhatia, Katy, Tex.

[73] Assignee: Exxon Chemical Patents Inc., Linden, N.J.

[21] Appl. No.: 48,358

[22] Filed: Apr. 13, 1993

[51] Int. Cl.[5] ..... C10G 29/20

[52] U.S. Cl. ..... 208/236; 208/237; 208/238; 208/208 R; 208/289; 208/290

[58] Field of Search ..... 208/238, 189, 206, 207, 208/192, 193, 208 R, 211, 237, 236, 238, 289, 290; 564/487; 423/228, 226; 44/336

[56] References Cited

U.S. PATENT DOCUMENTS 4,978,512 12/1993 Dillon ..... 423/226

5,162,049 11/1993 Bostick et al. ..... 44/336

*Primary Examiner*—Asok Pal

*Assistant Examiner*—Bekir L. Yildirim

*Attorney, Agent, or Firm*—R. L. Graham

[57] ABSTRACT

Reactive S (e.g. $H_2S$ and mercaptans) in petroleum liquid are scavenged by the use of oil soluble trialkyl hexahydro triazines wherein at least one alkyl group, and preferably all three, contain from 7 to 20 carbon atoms.

14 Claims, No Drawings

REMOVAL OF $H_2S$ HYDROCARBON LIQUID

BACKGROUND OF THE INVENTION:

This invention relates generally to the treatment of a hydrocarbon liquid such as crude oil or refined products to remove hydrogen sulfide and/or mercaptans therefrom. In an important aspect of the invention, the treatment involves the use of oil soluble amine scavengers. In another aspect, the invention relates to the use of nonregenerative scavengers to reduce the levels of $H_2S$ and mercaptans in hydrocarbon liquid, particularly water-free hydrocarbon liquids.

Many crude oils and condensates contain naturally occurring components such as acid gases and mercaptans which must be removed or neutralized at some point in the producing, storage, or refining operations. The toxicity of hydrogen sulfide and mercaptans in hydrocarbon streams is well known in the industry and considerable expense and efforts are expended annually to reduce its content to a safe level. Many pipeline and storage regulations require pipeline hydrocarbon liquid to contain less than 4 ppm hydrogen sulfide. Some refined oils also contain reactive S such as $H_2S$ and mercaptans and must be treated to lower the levels of their toxic substances.

Based on an article appearing in the *Oil & Gas Journal*, Jan. 30, 1989, nonregenerative scavengers for small plant hydrogen sulfide removal fall into four groups: aldehyde based, metallic oxide based, caustic based, and other processes. In the removal of hydrogen sulfide by nonregenerative compounds, the scavenger reacts with the hydrogen sulfide to form a nontoxic compound or a compound which can be removed from the hydrocarbon. As indicated above, the compounds useful in the method of the present invention are aldehyde type scavengers, specifically oil soluble scavengers.

Many of the aldehyde based scavengers form water soluble reaction products with $H_2S$, requiring the presence of water. For example, U.S. Pat. No. 4,978,512 discloses an $H_2S$ scavenger comprising the reaction product of an alkanol amine comprising 1 to 6 carbon atoms with an aldehyde containing 1 to 4 carbon atoms. The reaction product forms a water-soluble lower alkyl hexahydro triazine, since the lower alkyl groups impart water solubility to the triazine. U.S. Pat. No. 4,748,011 discloses an $H_2S$ scavenger for natural gas comprising an aldehyde (e.g. formaldehyde), a lower alkyl amine inhibitor and water (20–80%).

Oil soluble scavengers and suppressants are disclosed in the following patents and published applications:

(a) U.S. Pat. No. 2,783,205 discloses an acidic gas evolution suppressant for stabilized lubricating oils comprising the reaction product of a wide range of primary amines with a wide range of aldehydes, ketones, and ammonia.

(b) U.S. Pat. No. 2,675,373 discloses an aldehyde $H_2S$ evolution suppressant comprising aliphatic aldehydes and thiophene aldehydes.

(c) U.S. Pat. No. 5,074,991 discloses an oil soluble, $H_2S$ evolution suppressant comprising a diaminomethane compound.

(d) European Patent Application 0405719A discloses an oil soluble imine compound which is the reaction product of an amine or polyamine and an aldehyde, dialdehyde or ketone.

(e) European Patent Application 0411745A discloses an $H_2S$ scavenger comprising the reaction product of an alkylene polyamine with formaldehyde.

SUMMARY OF THE INVENTION:

In accordance with the method of the present invention, an $H_2S$ scavenger is added to a hydrocarbon liquid, which preferably is substantially water free, in sufficient quantities to substantially reduce the level of $H_2S$ and mercaptans therein. The scavenging composition is substantially oil soluble and is a 1,3,5 trialkyhexahydro-1,3,5 triazine wherein at least one of the alkyl groups is a $C_7$ to $C_{22}$ alkyl. The hexahydro triazine may have the following formula:

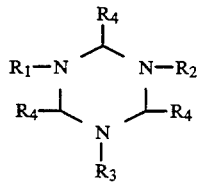

where $R_1$, $R_2$, and $R_3$ are independently $CH_3$ or an alkyl group containing from 2 to 22 carbon atoms, with at least one containing from 7 to 22 carbon atoms and each $R_4$ is independently H, $CH_3$, or $CH{=}CH_2$, preferably H.

The hexahydro triazine can be prepared by reacting certain alkyl amines or alkyl amine mixture with a lower aldehyde. The alkyl amines are primary amines having the formula of $RNH_2$ where R is an alkyl group (straight chain or branched and saturated or unsaturated) having from 7 to 22 carbon atoms, preferably from 8 to 18 carbon atoms. The aldehyde may be saturated or unsaturated aldehydes and having from 1 to 4 carbon atoms. In the case of a mixture of alkyl amines, at least one of the alkyl amines contains from 7 to 22 carbon atoms.

The method of the present invention involves adding the oil soluble hexahydro triazine scavenger described above to any liquid petroleum containing reactive S (e.g. $H_2S$ and mercaptans) in a sufficient quantity to effectively reduce the levels of reactive S therein. The method of the present invention is particularly suitable for treating petroleum liquids such as refined oil and distillates which are substantially water free.

Although the method of the present invention is described with specific reference to scavenging $H_2S$, it is to be understood that this is for description only and that by method can be used with oils containing any form of S reactive S, (e.g. mercaptans).

DESCRIPTION OF THE PREFERRED EMBODIMENTS

As mentioned above, a triazine derivative is the scavenging composition useful in the method of the present invention. The derivative, known as a hexahydro triazine, is the reaction product of a primary alkyl amine and a lower aldehyde The primary alkyl amines are fatty primary amines such as octylamine, dodecylamine, tetradecylamine, hexadecylamine, octadecylamine, docosylamine, cocoamine, tallow amine, hydrogenated tallow amine, etc. Commercially available fatty amines in general contain mixed alkyl chain lengths based on fatty acids, described in "Encyclopedia of Chemical Technology", KIRK-OTHMER, pp. 283 & 284 3rd Edition, Vol. 2; John Wiley & Sons, New York, the description of which is incorporated herein by reference.

The lower aldehyde preferably is formaldehyde, although other aldehydes such as acetaldehyde and acrolein may also be used.

The hydrocarbon liquid in which the scavenger may be used preferably is substantially water-free, which means the hydrocarbon liquid contains only a trace of water. For purposes of this present invention, the term "trace" means less than 2 volume percent water. Hydrocarbon liquids containing $H_2S$ and mercaptans include crude oil, NGL, LPG, condensates, fuel oils (specified in the ASTM D-396-86), refined fuels, diesel, naphtha, kerosene, Bunker Fuel Oil, #6 Fuel Oil, Marine Fuel Oil, etc. Since the scavenger is oil soluble, it is particularly applicable for the treatment of refined oils and condensates. (Condensate is light hydrocarbon liquid obtained by condensation of vapors.)

Reaction of Alkyl Amines and Lower Aldehydes

The condensation reaction of the primary amines and lower aldehydes produces a hexahydro triazine:

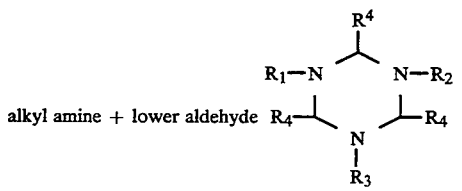

where $R_1$, $R_2$, $R_3$, and $R_4$ are as described above. Other compounds such as hydrocarbon solvents may be present in the final product. These include xylenes, aromatic naphtha and alcohols.

The reaction conditions may be as follows: mole ratio (amine: aldehyde) of 1:1 with a slight excess of amine. The reaction may be carried out in a solution of xylene or aromatic naphtha. The method of manufacturing the hexahydro triazine is described in the published literature. See, for example, U.S. Pat. No. 4,266,054, the disclosure of which is incorporated herein by reference.

The preferred hexahydro triazines are the reaction products of octylamine, cocoamine, and tallow amine which are available commercially in hydrocarbon solvents (5 to 95 wt % actives).

The hexahydro triazines described above, because of at least one relatively long R group, (e.g. 7–22 C atoms) are oil soluble and are capable of reacting with sulfides in the liquid hydrocarbon.

The preferred specific hexahydro triazines are 1,3,5 tri-n-octyl-hexahydro 1,3,5 triazine; 1,3,5 tridodecyl-hexahydro 1,3,5 triazine; and a mixture of hexahydro triazines containing $C_{16}$–$C_{18}$ alkyl groups such as those made from tallow acid.

Operations

In carrying out the method of the present invention, the scavenging composition is added to the hydrocarbon liquid in a concentration sufficient to substantially reduce the levels of $H_2S$ and/or mercaptans therein. Generally from 0.001 to 5 weight percent, preferably from 50 to 10,000 ppm, most preferably from 100 to 5000 ppm, of the active scavenging composition in the hydrocarbon liquid treated will be sufficient for most applications. In treating hydrocarbon liquid streams, the scavenging compound contained in a solvent, such as aromatic hydrocarbons or alcohol, may be injected by conventional means such as a chemical injection pump or any other mechanical means for dispersing chemicals in liquid.

In addition to the triazines described above, the chemical formulations may also contain other compounds such as ethoxylated alcohols, ethoxylated phenols, sulfates of ethoxylated alcohols and phenols, and quaternary amines. The formulation may also include surfactants or dispersants for dispersing the scavenger in the hydrocarbon liquid.

EXPERIMENTS

The scavenging compositions tested were prepared as follows:

Additive A:

A mixture of 195 g n-octyl amine and 45 g paraformaldehyde was heated to 60° C. and temperature maintained between 50 to 70° C. for two hours while stirring to produce an emulsion. The emulsion was separated into water and organic layers. The organic layer, 1,3,5-tri-n-octyl-hexahydro 1,3,5-triazine, was separated from the water.

Additive B:

Reaction as described above of 370 g lauryl amine and 60 g paraformaldehyde gave 1,3,5-tridodecyl-hexahydro 1,3,5-triazine.

Additive C:

Reaction as described above of 484 g tallow ($C_{16}$ and $C_{18}$) amine and 60 g paraformaldehyde gave a mixture of hexahydro triazines containing $C_{16}$ and $C_{18}$ alkyl groups.

Test Procedure

The analytical method used in the evaluation of the scavengers was based on a proposed ASTM Method SM 360-6, except the equilibration of the samples was at 82° C. for 4 hours or 60° C. for 12 hours instead of 40 minutes as described in ASTM SM 360-6.

The tests were carried out as follows:

1. In each of several 1 quart (or 1 liter) bottles 500 ml of substantially water-free sour oil (#3 Fuel Oil from a refinery) was poured. Two bottle samples were blanks. The remaining bottle samples were treated with Additive A or B or C as indicated. These samples are referred to as Samples A, B, and C, respectively.
2. All bottles were shaken to obtain homogeneous mixing and placed in a water bath heated to 82° C. Samples were allowed to equilibrate for 4 hours.
3. Each bottle was removed from hot bath and manually shaken 100 times (or for 3 minutes on a mechanical shaker at 150 rpm) and then immediately the $H_2S$ readings in the vapor space of the bottles were taken using Drager tubes. Effective scavenging of $H_2S$ results in low values of $H_2S$ in the vapor phase Table I presents the results of the experiments and demonstrates the effectiveness of Additives A and B

TABLE I

| SAMPLE | ADDITIVE DOSE, ppm | $H_2S$, ppm, IN VAPOR SPACE |
|---|---|---|
| Blank I | 0 | 1150 |
| Blank II | 0 | 1200 |
| Additive A | 200 | 200 |
| | 400 | 80 |
| Additive B | 200 | 400 |

TABLE I-continued

| SAMPLE | ADDITIVE DOSE, ppm | $H_2S$, ppm, IN VAPOR SPACE |
|---|---|---|
| | 400 | 250 |

Additional tests were conducted to compare performance of the 3 scavengers (Additives A, B, and C) to that of formaldehyde using the experimental method described above. Treatment dose concentrations were selected to compensate for the calculated effect of molecular weight changes so that the treatments were on the same mole basis. The results are presented in TABLE II.

TABLE II

| SAMPLE | ADDITIVE DOSE, ppm | $H_2S$, ppm, IN VAPOR SPACE |
|---|---|---|
| Blank I | 0 | 1200 |
| Formaldehyde | 200 | 950 |
| Additive A | 950 | 20 |
| Additive B | 1300 | 80 |
| Additive C | 1700 | 50 |

The above tests demonstrate that the oil soluble triazine is stable in petroleum which is substantially free of water and that the triazine is an effective scavenger.

What is claimed is:

1. A method of reducing $H_2S$ and reactive S in a petroleum liquid which comprises adding to the petroleum liquid an oil soluble scavenging composition comprising a hexahydro triazine having the following formula:

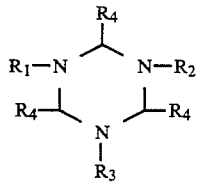

where $R_1$, $R_2$, and $R_3$ are each independently $CH_3$ or alkyl groups containing from 2 to 22 C atoms, wherein at least one is an alkyl group containing from 7 to 22 carbon atoms and each $R_4$ is independently H, $CH_3$, or $CH{=}CH_2$.

2. The method of claim 1 wherein the hydrocarbon liquid is substantially free of water.

3. The method of claim 1 wherein the hexahydro triazine is present in the liquid at a concentration of 0.001 to 5 wt %.

4. The method of claim 1 wherein $R_1$, $R_2$, and $R_3$ are the same.

5. The method of claim 4 wherein each $R_4$ is H.

6. The method of claim 1 wherein the triazine is prepared by reacting a lower aldehyde with tallow amine.

7. The method of claim 1 wherein the petroleum liquid is a condensate.

8. The method of claim 1 wherein at least one of $R_1$, $R_2$, and $R_3$ is an alkyl group containing from 8 to 18 carbon atoms.

9. The method of claim 1 wherein the triazine is the reaction product of a primary alkyl amine having from 7 to 22 carbon atoms and an aldehyde having from 1 to 4 carbon atoms.

10. The method of claim 1 wherein the petroleum liquid is crude oil.

11. The method of claim 1 wherein the crude oil contains a trace of water.

12. A method of reducing $H_2S$ in a substantially water-free petroleum liquid which comprises:

(a) introducing from 50 to 10,000 ppm of a 1,3,5 trialkyl hexahydro-1,3,5 triazine into the petroleum liquid, each of said alkyl groups containing from 8 to 20 carbon atoms; and (b) permitting the triazine to react with $H_2S$ in the petroleum liquid.

13. The method of claim 12 wherein the petroleum liquid is a refined oil.

14. The method of claim 12 wherein the petroleum liquid is a condensate.

* * * * *